US007955095B1

(12) United States Patent
Yang

(10) Patent No.: US 7,955,095 B1
(45) Date of Patent: Jun. 7, 2011

(54) BATTERY CONNECTOR AND CONTACT USED THEREIN

(75) Inventor: Chih-Lin Yang, Tu-Cheng (TW)

(73) Assignee: Cheng UEI Precision Industry Co., Ltd., Tu-Cheng, Taipei Hsien (TW)

( * ) Notice: Subject to any disclaimer, the term of this patent is extended or adjusted under 35 U.S.C. 154(b) by 0 days.

(21) Appl. No.: 12/696,049

(22) Filed: Jan. 28, 2010

(51) Int. Cl.
*H01R 12/00* (2006.01)

(52) U.S. Cl. ..... 439/83

(58) Field of Classification Search ..... 439/83, 439/79–80, 247, 682, 862, 286–287
See application file for complete search history.

(56) References Cited

U.S. PATENT DOCUMENTS 5,564,952 A * 10/1996 Davis ..... 439/682
5,618,187 A * 4/1997 Goto ..... 439/79
6,039,590 A * 3/2000 Kunishi ..... 439/247
6,394,818 B1 * 5/2002 Smalley, Jr. ..... 439/79
7,083,433 B2 * 8/2006 Misawa et al. ..... 439/80
7,357,665 B1 * 4/2008 Yan ..... 439/500
7,775,822 B2 * 8/2010 Ngo et al. ..... 439/290
2003/0186571 A1 * 10/2003 Lin ..... 439/83

* cited by examiner

*Primary Examiner* — Jean F Duverne
(74) *Attorney, Agent, or Firm* — Cheng-Ju Chiang

(57) ABSTRACT

A battery connector, for being mounted to a printed circuit board, includes an insulating housing defining a front surface, a rear surface and a mounting surface. The front surface has a plurality of contact receiving cavities spaced from one another. An upper partition formed in the contact receiving cavity. A plurality of contacts is received in the contact receiving cavities respectively. Each of the contacts has a contact portion of substantially big rectangular block shape, a soldering portion, and a connecting portion having two ends connected with a lower edge of the rear end of the contact portion and a top edge of the soldering portion. The contact has an upper notch receiving and clamping the upper partition. The soldering portion has two opposite ends substantially flush with that of the contact portion.

7 Claims, 5 Drawing Sheets

BATTERY CONNECTOR AND CONTACT USED THEREIN

BACKGROUND OF THE INVENTION

1. Field of the Invention

The present invention relates to a battery connector, and particularly to a battery connector suitable for being soldered to a PCB (Printed Circuit Board).

2. The Related Art

U.S. Pat. No. 4,632,475, discloses an electrical connector including a long, narrow male housing with a plurality of male contacts received therein. The male housing has a plurality of cavities which are equidistantly spaced in a longitudinal direction of the male housing. Notched portions and stepped portions are formed in each cavity. The male contacts are respectively secured in each cavity. Each one of male contacts is right angle type and includes post portion, first projection, second projection and projection tongue. The post portion extends through a square formed on a bottom of cavity and is inserted into a hole of a printed circuit board. The first projection is disposed in notched portion and the second projection engages with stepped portion so that the male contact is retained in the cavity. The projection tongue protrudes from a front side of the male housing.

However, the printed circuit board must be made some holes for receiving the post portion so that the post portion can be soldered to the solder pad of the printed circuit board. It would break the printed circuit board and the wiring region is limited. In addition, the first projection and the second projection are weak to secure the contact in the housing, when the front end of the projection tongue subject to a strong pressure, the contact is likely to be break.

SUMMARY OF THE INVENTION

Accordingly, an object of the present invention to provide an battery connector having an improved contact which can surface mount to a printed circuit board.

In order to achieve the objects set forth, according to one aspect of the present invention, there is provided a battery connector for mounting to a printed circuit board, includes an insulating housing defining a front surface, a rear surface and a mounting surface perpendicularly connecting with the front surface and the rear surface. The front surface has a plurality of contact receiving cavities spaced from one another. Each of the contact receiving cavities extends perpendicular to the mounting surface, reaches the mounting surface. An upper partition is formed in the contact receiving cavity. A plurality of contacts is received in the contact receiving cavities respectively. Each of the contacts has a contact portion of substantially rectangular block shape, a soldering portion, and a connecting portion having two ends connected with a lower edge of the rear end of the contact portion and a top edge of the soldering portion. The contact has an upper notch receiving and clamping the upper partition. The soldering portion has two opposite ends substantially flush with that of the contact portion, and a bottom surface flush with the mounting surface for lying on the printed circuit board when the mounting surface of the insulating housing is attached to the printed circuit board.

Also, according to another aspect of the present invention, there is provided a contact adapted for being mounted to a printed circuit board by the SMT soldering, includes a contact portion of substantially big rectangular block shape having a upper notch split the rear end portion into two protrusions, a connecting portion extending downwardly from a lower edge of the lower protrusions, and a soldering portion of substantially elongated block shape connected with the connecting portion by a portion of a top surface thereof jointed with a lower portion of the connecting portion. The soldering portion is lain on the printed circuit board and has two opposite ends substantially flush with that of the contact portion.

As described above, the battery connector has a contact which has a elongated soldering portion, so as to keep the contact standing up and make the battery connector suitable for soldering to the surface of the printed circuit board, especially, by SMT soldering. In addition, the contact provides the upper notch to engage the upper partition. Therefore, the contact would be retained in the insulating housing. According to the present invention, the printed circuit board doesn't need to form some through holes for fixing the contacts, so the wiring layout design is freer, without the restriction of the through holes.

BRIEF DESCRIPTION OF THE DRAWINGS

The present invention will be apparent to those skilled in the art by reading the following description thereof, with reference to the attached drawings, in which.

DETAILED DESCRIPTION OF THE EMBODIMENT

Figure 1:
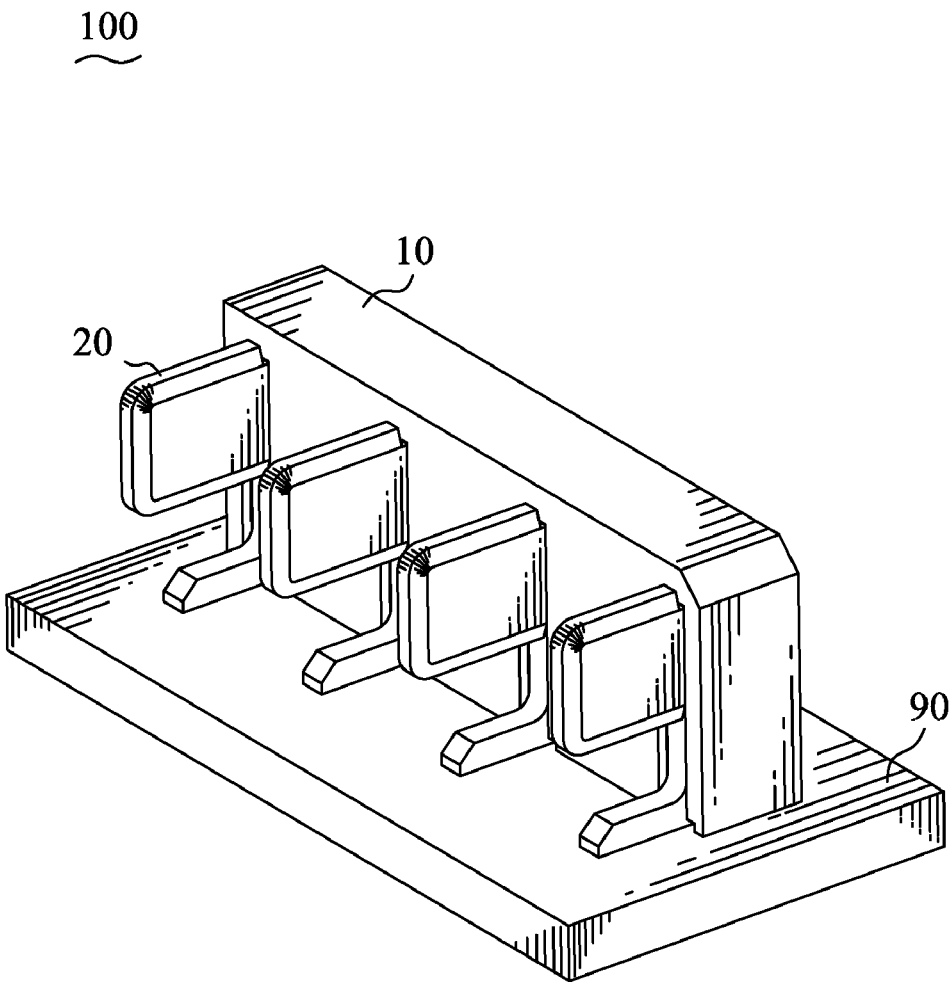
FIG. 1 is a perspective view of a battery connector of an embodiment in accordance with the present invention.
Figure 2:
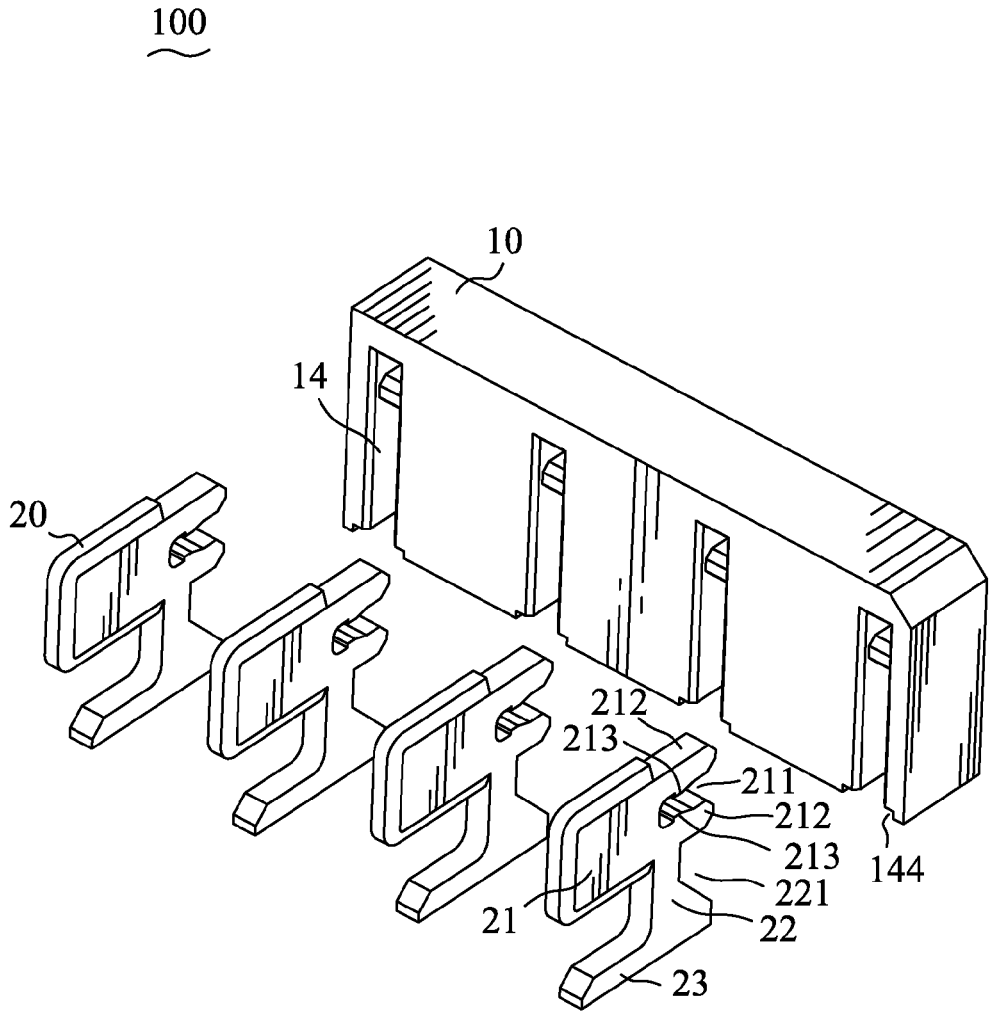
FIG. 2 is an exploded, perspective view of the battery connector shown in FIG. 1.
Figure 3:
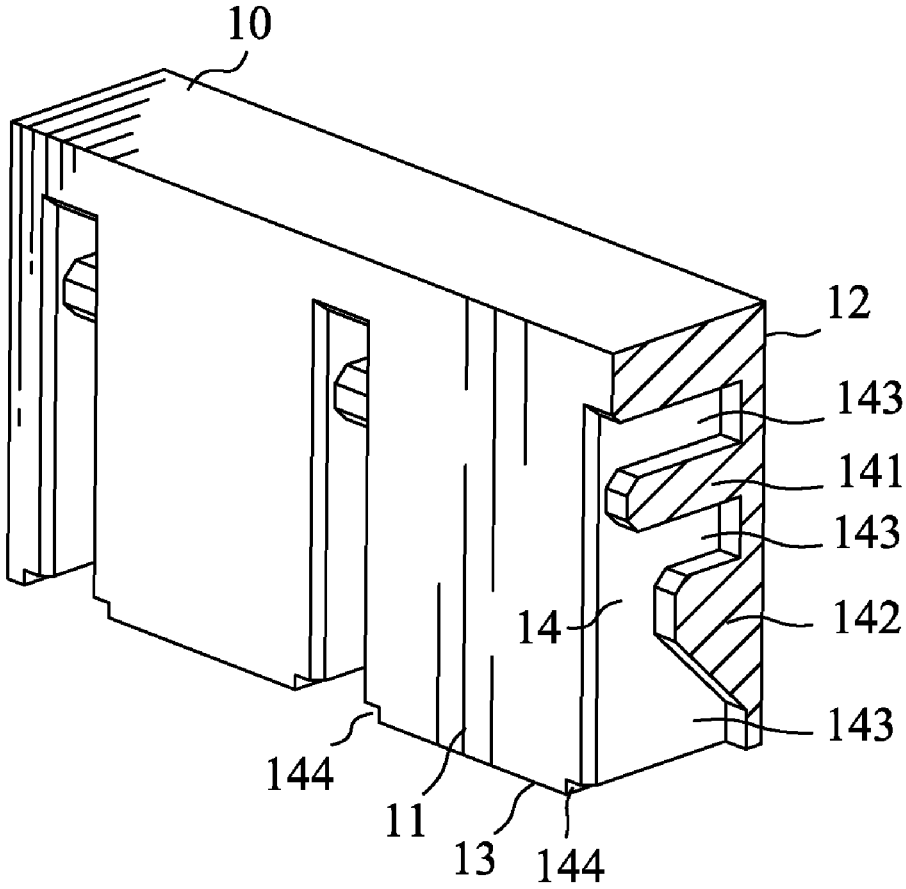
FIG. 3 is a cross-sectional view of an insulating housing of the battery connector shown in FIG. 2.

Referring to the drawings in greater detail, and first to FIGS. 1-3, the first embodiment of the invention is shown as an battery connector 100 adapted for mounting on a PCB (printed circuit board) 90. The battery connector 100 comprises an insulating housing 10 and a plurality of contacts 20 received in the insulating housing 10. The housing 10 is in an approximately rectangular parallelepiped shape and has a front surface 11, a rear surface 12 and a mounting surface 13 perpendicularly connecting with the front surface 11 and the rear surface 12. A plurality of contact receiving cavities 14 are provided in the front surface 11 side by side for receiving the contacts 20 and open to the mounting surface 13. The contact receiving cavities 14 extend perpendicular to the mounting surface 13 and are spaced from each other with certain distance. An upper partition 141 and a lower partition 142 are extended forwardly from a bottom of each contact receiving cavity 14, without beyond the front surface 11. The upper partition 141 and the lower partition 142 are spaced from each other and divide the contact receiving cavity 14 into three chambers 143. Two opposite sides of each contact receiving cavity 14 have lower portions formed with grooves 144 which is exposed to the mounting surface 13.

The contacts 20 are formed by stamping a metal sheet. As shown in FIG. 2, each contact 20 includes a contact portion 21, a connecting portion 22 extending downwardly from a rear end of the contact portion 21, and a soldering portion 23 connecting a bottom of the connecting portion 22. The contact portion 21 is a substantially vertical big rectangular block. Most of the contact portion 21 protrudes outside from the front surface 11 of the insulating housing 10, and is adapted for engaging with a terminal of a mating connector (not shown). An upper notch 211 splits a rear end portion of the contact portion 21 into two protrusions 212. Each of two opposite sides of the upper notch 211 has a barb 213. The barbs 213 face each other and both extend into the upper notch 211, thereby forming a clamping structure for clamping the upper partition 141. The soldering portion 23 is a substantially elongated block and has a rear end of a top surface connected with the bottom of the connecting portion 22. The soldering portion 23 extends forwardly and rearwards, with two ends substantially flush with that of the contact portion 21. Therefore, a lower notch 221 is formed beside the connecting portion 22, positioned between the lower protrusion 212 and the rear end portion of the soldering portion 23, spaced from the upper notch 211. The lower notch 221 is engaged with the lower partition 142.

In assembly, each contact 20 is inserted into the corresponding contact receiving cavity 14. Two protrusions 212 of the contact 20 are respectively inserted into the chambers 143, and the upper partition 141 is buckled in the upper notch 211. The rear end of the soldering portion 23 is received in the remaining clamber 143. Therefore, the upper partition 141 is kept in the upper notch 211, and the lower partition 142 is kept in the lower notch 221. The contacts 20 are retained in the contact receiving cavities 14 respectively.

The battery connector 100 is mounted on the printed circuit board 90 by the SMT (Surface Mounting Technology) soldering. Each groove 144 of the contact receiving cavities 14 would provide enough space for the SMT soldering. The connecting portion 22 only support the rear end of the contact portion 21 and most of the contact portion 21 protrude outside the insulating housing 10, if the top surface of the front-end contact portion 21 subject to a pressure, in general, the contact 20 will be disposed to rotate downwardly around the bottom of the soldering portion 23 which acts as a pivot. Furthermore, if the force is excessively strong, the contact 20 will be likely to be deformed, even be broken away from the battery connector 100. In the present invention, the soldering portion 23 of the contact 20 extends forwardly under the contact portion 21. Moreover, the front end of the soldering portion 23 substantially flushes with that of the contact portion 21. Such elongated soldering portion 23 combining with the above clamping structure at the rear end of contact portion 21 can against the trend of rotation and maintain the contact in a stable condition. In addition, the elongated soldering portion 23 can provide more solder area. It would facilitate soldering. The battery connector 100 according to the present invention doesn't break the printed circuit board 90, which is more convenient to design and arrange the wiring layout.

Figure 4:
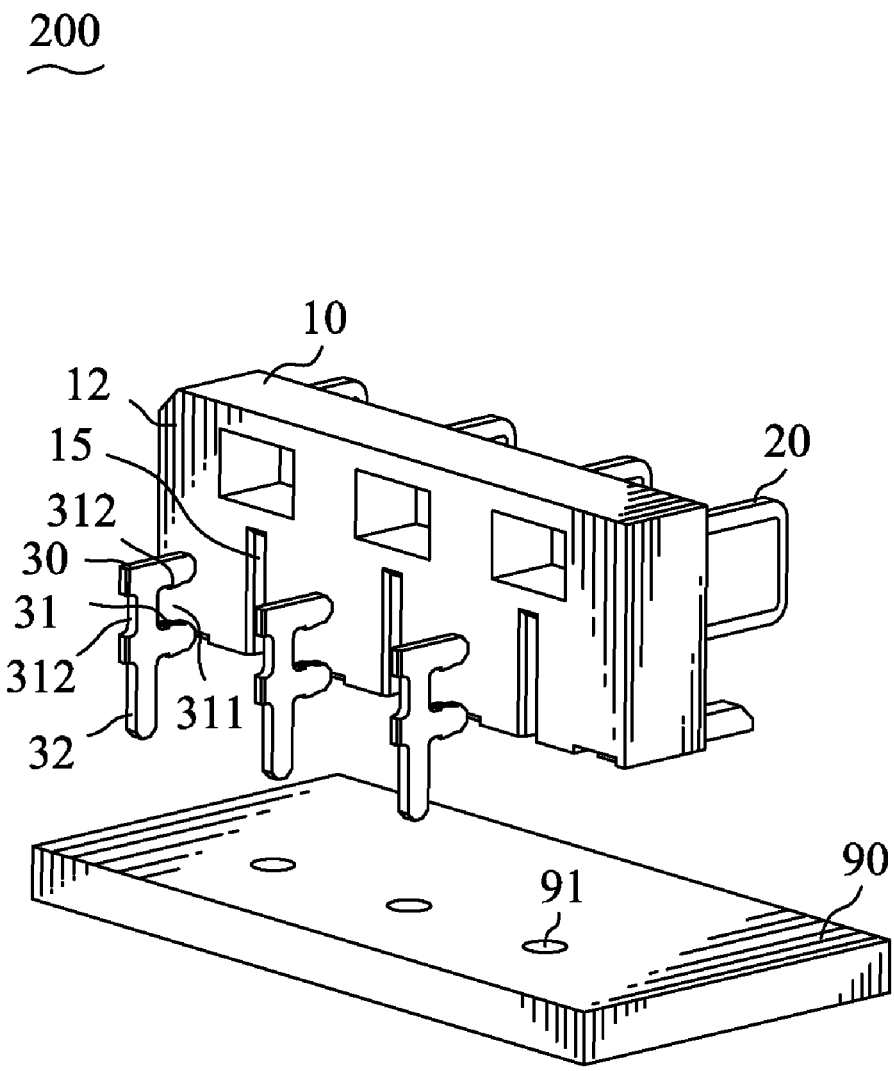
FIG. 4 is a perspective view of a battery connector of the second embodiment in accordance with the present invention.
Figure 5:
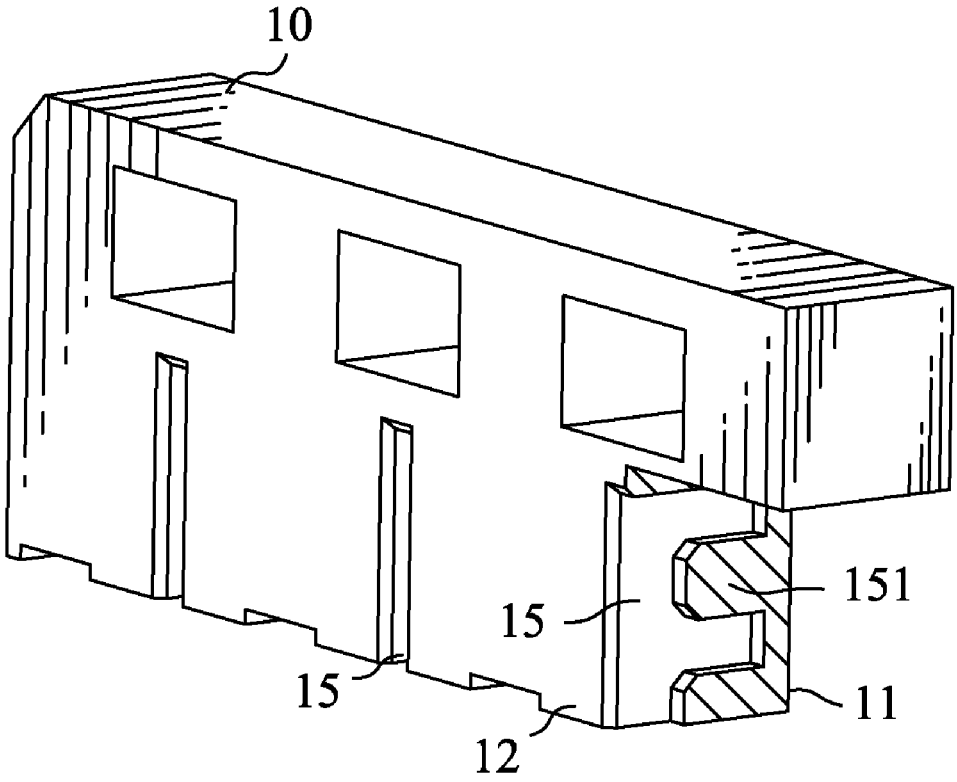
FIG. 5 is a cross-sectional view of an insulating housing of the battery connector shown in FIG. 4 viewed from rear angle.

FIGS. 4 and 5 illustrate the second embodiment of a battery connector 200 according to the present invention. In comparison with the battery connector 100 in the first embodiment, the battery connector 200 in the second embodiment further includes a plurality of fixing members 30 for preventing the insulating housing 10 from being pulled out of the PCB 90. The rear surface 12 has a plurality of abreast fixing slots 15 for receiving the fixing members 30. Each of the fixing slots 15 extends upwards and downwards and is disposed between two adjacent contact receiving cavities 14, spaced from one another. A middle partition 151 is extended rearwardly from a bottom of each fixing slot 15, without beyond the rear surface 12. The fixing member 30 is substantially F-shaped, and defines a base body 31 and a tail 32. The base body 31 has a fixing notch 311, with at least one barb 312 formed at an inner edge thereof. When the middle partition 151 is inserted into the notch 311, the base body 31 clamps the middle partition 151 by the barb 312, thereby the fixing member 30 is retained in the fixing slot 15. The tail 32 extends downwardly from the base body 31 and is soldered to the corresponding through hole 91 of the PCB 90. The insulating housing 10 is mounted on the printed circuit board 90 by the fixing members 30. Furthermore, the fixing members 30 can also be directly soldered on a top surface of the PCB 90 by the SMT soldering without using the tail 32 through the PCB 90.

The foregoing description of the present invention has been presented for the purposes of illustration and description. It is not intended to be exhaustive or to limit the invention to the precise form disclosed, and obviously many modifications and variations are possible in light of the above teaching. Such modifications and variations that may be apparent to those skilled in the art are intended to be included within the scope of this invention as defined by the accompanying claims.

What is claimed is:

1. A battery connector for being mounted to a printed circuit board, comprising:

an insulating housing defining a front surface, a rear surface and a mounting surface perpendicularly connecting with the front surface and the rear surface, the front surface having a plurality of contact receiving cavities spaced from one another, each of the contact receiving cavities extending perpendicular to the mounting surface, reaching the mounting surface;

a plurality of contacts received in the contact receiving cavities respectively, each of the contacts having a contact portion of substantially rectangular block shape, a soldering portion, and a connecting portion having an upper end connected with a lower edge of a rear end of the contact portion and a lower end connected with a top edge of the soldering portion; wherein an upper partition is formed in the contact receiving cavity and extends forwardly from a bottom of the contact receiving cavity, without beyond the front surface;

the insulating housing further includes a lower partition formed in the contact receiving cavity and extending forwardly from a bottom thereof without beyond the front surface, the upper partition and the lower partition are spaced from each other and divide the contact receiving cavity into three chambers;

the contact has an upper notch receiving and clamping the upper partition, the upper notch splits the rear end of the contact portion into two protrusions; and the soldering portion has two opposite ends substantially flush with that of the contact portion, and a bottom surface substantially flush with the mounting surface for lying on the printed circuit board when the mounting surface of the insulating housing is attached to the printed circuit board; wherein the contact further includes a lower notch formed beside the connecting portion, between a lower protrusion of the two protrusions and a rear end portion of the soldering portion, the two protrusions respectively are inserted into the chambers at both sides of the upper partition and clamping the upper partition, the rear end portion of the soldering portion is received in the remaining clamber, and the lower notch is engaged with the lower partition.

2. The battery connector as claimed in claim 1, wherein each of the protrusions provides a barb on an inner edge thereof, and said barbs face each other and both extend into the upper notch.

3. The battery connector as claimed in claim 1, wherein most of the contact portion protrudes outside from the front surface of the insulating housing.

4. The battery connector as claimed in claim 1, wherein two opposite sides of the contact receiving cavity have lower portions formed with grooves, the grooves are exposed to the mounting surface.

5. A battery connector for being mounted to a printed circuit board, comprising:

an insulating housing defining a front surface, a rear surface and a mounting surface perpendicularly connecting with the front surface and the rear surface, the front surface having a plurality of contact receiving cavities spaced from one another, each of the contact receiving cavities extending perpendicular to the mounting surface, reaching the mounting surface;

a plurality of contacts received in the contact receiving cavities respectively, each of the contacts having a contact portion of substantially rectangular block shape, a soldering portion, and a connecting portion having an upper end connected with a lower edge of a rear end of the contact portion and a lower end connected with a top edge of the soldering portion; wherein an upper partition is formed in the contact receiving cavity;

the contact has an upper notch receiving and clamping the upper partition;

the soldering portion has two opposite ends substantially flush with that of the contact portion, and a bottom surface substantially flush with the mounting surface for lying on the printed circuit board when the mounting surface of the insulating housing is attached to the printed circuit board; and the insulating housing further has a plurality of fixing slots spaced on the rear surface side by side, a middle partition formed in the fixing slot and extending rearwardly from a bottom thereof, without beyond the rear surface, a plurality of fixing members receiving in the fixing slots respectively and mounted on the printed circuit board, wherein the fixing member defines a fixing notch, the middle partition inserted into the fixing notch.

6. The battery connector as claimed in claim 5, wherein the fixing member is substantially F-shaped and defining a base body and a tail, the base body formed a barb protruding into the fixing notch and clamping the middle partition, the tail extending downwardly from the base body and soldered on the printed circuit board.

7. A contact adapted for being mounted to a printed circuit board by the SMT soldering, comprising:

a contact portion of substantially rectangular block shape having an upper notch splitting a rear end portion of the contact portion into two protrusions;

a connecting portion extending downwardly from a lower edge of a lower protrusion of the two protrusions; and a soldering portion of substantially elongated block shape connected with the connecting portion by a portion of a top surface thereof jointed with a lower portion of the connecting portion; wherein the soldering portion is lain on the printed circuit board and has two opposite ends substantially flush with that of the contact portion, and the contact is formed by stamping a metal sheet, each of the protrusions provides a barb on an inner edge thereof, said barbs face each other and both extend into the upper notch.

* * * * *